US007304554B2

(12) United States Patent
Obata

(10) Patent No.: US 7,304,554 B2
(45) Date of Patent: Dec. 4, 2007

(54) U-SHAPED MICROWAVE AND MILLIMETER WAVE RESONATOR FILTER

(75) Inventor: Hideyuki Obata, Kamifukuoka (JP)

(73) Assignee: New Japan Radio Co., Ltd., Tokyo-To (JP)

( * ) Notice: Subject to any disclaimer, the term of this patent is extended or adjusted under 35 U.S.C. 154(b) by 49 days.

(21) Appl. No.: 11/135,930

(22) Filed: May 23, 2005

(65) Prior Publication Data

US 2005/0264379 A1 Dec. 1, 2005

(30) Foreign Application Priority Data

May 28, 2004 (JP) ..... 2004-158937

(51) Int. Cl.

| | |
|---|---|
| ***H03C 7/02*** | (2006.01) |
| ***H01P 5/12*** | (2006.01) |
| ***H01P 1/20*** | (2006.01) |
| ***H01P 3/00*** | (2006.01) |
| ***H01P 1/02*** | (2006.01) |

(52) U.S. Cl. ..... 333/212; 333/81 B; 333/135; 333/208; 333/239; 333/249

(58) Field of Classification Search ..... 333/212, 333/208, 81 B, 135, 239, 249
See application file for complete search history.

(56) References Cited

U.S. PATENT DOCUMENTS

| | | | | |
|---|---|---|---|---|
| 5,608,363 | A * | 3/1997 | Cameron et al. | 333/202 |
| 6,181,224 | B1 * | 1/2001 | Glinder | 333/208 |
| 6,191,670 | B1 * | 2/2001 | Nguyen | 333/208 |
| 6,710,678 | B2 * | 3/2004 | Thormar | 333/135 |
| 6,876,277 | B2 * | 4/2005 | Cooper | 333/208 |

FOREIGN PATENT DOCUMENTS

| | | |
|---|---|---|
| GB | 1294502 | 11/1972 |
| JP | 7050501 | 2/1995 |
| JP | 2001230603 | 8/2001 |
| JP | 2003209406 | 7/2003 |
| JP | 2004-147001 | 5/2004 |

OTHER PUBLICATIONS

*Patent Abstracts of Japan, Publication No. 2004-147001, Band Pass Filter, published May 20, 2004.

* cited by examiner

*Primary Examiner*—Robert Pascal
*Assistant Examiner*—Kimberly E Glenn
(74) *Attorney, Agent, or Firm*—Ware, Fressola, Van Der Sluys & Adolphson

(57) ABSTRACT

A filter including a body on which a waveguide groove, whose one surface is open, is formed in a U-shape and a plurarity of inductive resonant windows are provided along a longitudinal direction of the waveguide groove at a predetermined interval in the waveguide groove; and a cover being provided on a top surface of the body so as to cover the surface being open, wherein the plurality of inductive resonant windows are provided in such a manner that a cavity, which is enclosed by two of the plurality of inductive resonant windows being adjacent, the body and cover, resonates at a predetermined frequency and passes a electromagnetic wave in a predetermined frequency band and wherein one end of the U-shaped waveguide groove is an input terminal and other end is an output terminal, and the input terminal and output terminal are formed on a same surface.

4 Claims, 4 Drawing Sheets

U-SHAPED MICROWAVE AND MILLIMETER WAVE RESONATOR FILTER

BACKGROUND OF THE INVENTION

The present invention relates to a filter for microwave and millimeter waves which passes desired frequency bands and interrupts unnecessary frequency bands. More particularly, the present invention relates to a filter which saves space when employed as a waveguide and which enables simplification when built into a microwave circuit.

As for a band-pass filter employing a cavity, there has been a known filter whose arrangement is shown in schematic view in FIG. 5. In this arrangement, an iris plate 32 is inserted into a rectangular waveguide 31, and the iris plate 32 acts as an inductive resonant window (reactance element) and a plurality of pairs of resonant windows are provided along the tube axis direction. A cavity resonator is formed in the space between two adjacent resonant windows in the longitudinal direction and the tube walls of the rectangular waveguide 31. The iris plate 32 is provided to obtain desired band characteristics through design choices, such as the distance between adjacent resonant windows in the longitudinal direction or the size of the resonant window opening (distance between a pair of iris plates). In the example shown in FIG. 5, the iris plate 32 is illustrated in a perspective view with three layers of cavity resonators being connected in series therein. By arranging a filter by connecting a plurality of cavity resonators, it is possible to arrange a filter which enables one to obtain a sharp attenuation of a rejection band, in other words, a filter which enables one to obtain large attenuation at a rejection frequency being close to the pass band, as compared with an arrangement of a filter employing one cavity resonator (for example, see Japanese Unexamined Patent Publication No. 230603/2001).

In order to improve filter characteristics, multiple layers of cavity resonators are required to be connected. However as shown in the above-mentioned arrangement, the cavity resonators are connected in a linear manner and it become longer with an increased number of layers, since one cavity resonator has to have ½ the inside tube wavelength. Accordingly, there has been a problem in that it becomes extremely difficult to insert the cavity resonators into a microwave circuit. In addition, it is impossible to build the multiple layers of iris plates into the waveguide, and the waveguide is required to be connected after being divided along a center line in an axis direction or separating the wider surface and connected with the iris plates.

On the other hand, as shown in FIG. 6, there is a known filter arranged through forming multiple layers of cavity resonators being divided by iris 34 through forming a waveguide groove pattern 35 having iris 34 in a conductive casing 33 and covering the surface of the conductive casing 33 by a cover not shown in figures, and the filter also has a desired frequency characteristics in such a manner as the above-mentioned example (for example, see Japanese Unexamined Patent Publication No. 209406/2003). In an example shown in the last cited reference, there is described a filter being capable of passing only the desired frequency characteristics while bending the propagation direction of an electromagnetic wave at 90°. It is disclosed that corners of the cavity are formed in a special shape in order to bend the propagation direction of an electromagnetic wave at 90°.

As mentioned above, multiple layers of resonators are required to be connected through inductive resonant windows for improving the filter characteristics with respect to the conventional filters having a waveguide form. Therefore, the layout of the microwave circuit has to be modified, since multiple layers of resonators become longer and are difficult to be inserted into the existing circuit (microwave circuit). In addition, there have been problems of leakage of radio waves or characteristic deterioration in case there is a space between the filter and existing circuit, and there have been problems of characteristic deterioration in the case where there is a deformation of the microwave circuit by forcible fastening to avoid the space. The same problems are applied to the above-mentioned arrangement in FIG. 6 in which the propagation direction of the electromagnetic wave is bent at 90°. There is no problem in the case where the microwave circuit is assembled from the beginning or the microwave circuit includes one block. However, in the case where the microwave circuit is already built-in there is a problem in replacing filters in that a different filter cannot be built-in for improving the filter characteristics.

In order to obtain the sharp cut-off frequency characteristics of the filter or large attenuation of unnecessary frequency band as mentioned above, the number of cavity resonators is required to be increased to include multiple layers. However, there has been a problem that space efficiency is extremely reduced, since multiple layers of cavity resonators become extremely long in the case where they are connected in a straight line, and a large area is occupied even if the propagation direction is bent at 90°.

The present invention is provided to solve the above-mentioned problems. An object of the present invention is to provide a filter with an arrangement of waveguide form, which can be simply replaced with a filter having high performance without changing the layout of an existing microwave circuit, and certainly connected to filters without causing deterioration of characteristics.

Another object of the present invention is, even if the waveguide is divided into a body and cover, to provide a filter, which enables prevention of leakage of electromagnetic waves at a connecting part through providing the connecting part where the electric field is weakest.

SUMMARY OF THE INVENTION

A filter of the present invention includes a body on which a waveguide groove, whose one surface is open, is formed in U-shape and a plurality of inductive resonant windows are provided along a longitudinal direction of the waveguide groove at a predetermined interval in the waveguide groove, and a cover being provided on a top surface of the body so as to cover the surface being open, wherein the plurality of inductive resonant windows are provided in such a manner that a cavity, which is enclosed by two of the plurality of inductive resonant windows being adjacent, the body and cover, resonates at a predetermined frequency and passes a electromagnetic wave in a predetermined frequency band and wherein one end of the U-shaped waveguide groove is an input terminal and other end is an output terminal, and the input terminal and output terminal are formed on a same surface.

The U-shape is meant to be an arrangement in which the waveguide is folded back at 180°. The corner of the waveguide is not necessarily in an arc shape and includes an arrangement in which the corner is folded back in an angle.

In the case waveguide groove is provided in such a manner that a wider surface of a waveguide is to be a depth direction of the groove, a narrower surface of the waveguide is provided by the cover and two wider surfaces are attached on their back with respect to the input terminal and output terminal, the inductive resonant windows are not formed at the folded back portion and the waveguide is folded without taking a large space. In addition, since a connecting part of the body and cover is to be at the weakest portion of electric field, electric discharge and leakage of electromagnetic waves rarely takes place, thereby it is preferable. In such a case, the inductive resonant windows do not have an arrangement where the window members (iris plates) are provided at both ends of the wider surface of the waveguide, but have an asymmetric arrangement where the window members are provided only at one side (bottom side of the waveguide). The resonant characteristics can be adjusted through such as an adjustment screw being provided on the cover, and the desired frequency characteristics can be obtained.

The waveguide groove may be provided in such a manner that a narrower surface of a waveguide is to be a depth direction of the groove, a wider surface of the waveguide is provided by the cover and two wider surfaces are laterally aligned relative to the input terminal and output terminal.

In at least one end side of the input terminal and output terminal, a reactance member, which narrows the waveguide groove, is provided inside the waveguide groove, thereby the impedance matching is achieved. The matching characteristics are thus improved, and mutual interference between the filter and circuit in series can be prevented. Through providing the reactance member, which narrows the waveguide, at a portion of at least one side of wider surface and narrower surface of the waveguide, matching characteristics can be improved.

Through forming a partition plate, which divides input side and output side of the U-shaped waveguide groove, so as to project from the same surface formed by the input terminal and output terminal, electric connection between the circuit in series and filter can be certainly carried out. Therefore, deterioration of characteristics by the connection can be prevented, since there is no gap inbetween.

According to the filter of the present invention, the waveguide groove is formed in U-shape and the input terminal and output terminal are formed on the same surface. Therefore, even if the full length of the filter has the same characteristics as the conventional arrangement with a straight connection of resonators, it is possible to arrange the filter having the desired characteristics with substantially half the length. In addition, since input and output terminals are formed on the same surface, through grouping the input terminal and output terminal on the same surface of the microwave circuit side, the filter can be certainly inserted into the microwave circuit by only attaching the filter with a screw without putting into the microwave circuit. Accordingly, it is possible to replace filters without affecting the microwave circuit if the length of the layer (number of resonators) is increased to obtain the high performance of the filter or the length is decreased. Furthermore, since it is possible to connect resonators without giving any load for the microwave circuit, the microwave circuit and filter are not deformed, and transmission characteristics and filter characteristics are not deteriorated.

In addition, through forming that the depth direction of the waveguide groove to be the wider surface of waveguide, the filter becomes extremely miniaturized, since it is possible to compactly fold back by a form in which the wider surfaces are put together (through only a partition plate, in practice) on their back sides. It is also possible to obtain extremely miniaturized and high characteristic filter, since the connecting part, which connects the body and cover, becomes the weakest electric field part, and problems such as electric discharge by burr and leakage of electromagnetic wave at the connecting part are not generated.

DETAILED DESCRIPTION

Figure 1A:
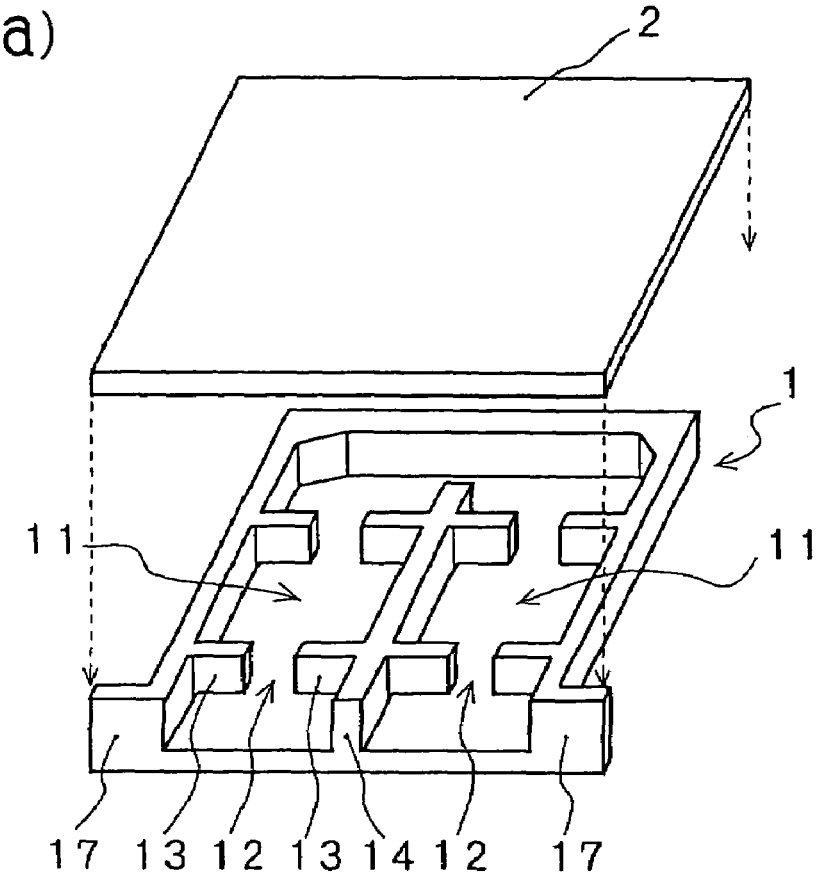
FIG. 1(*a*) and FIG. 1(*b*) are views explaining one Embodiment of a filter according to the present invention.
Figure 1B:
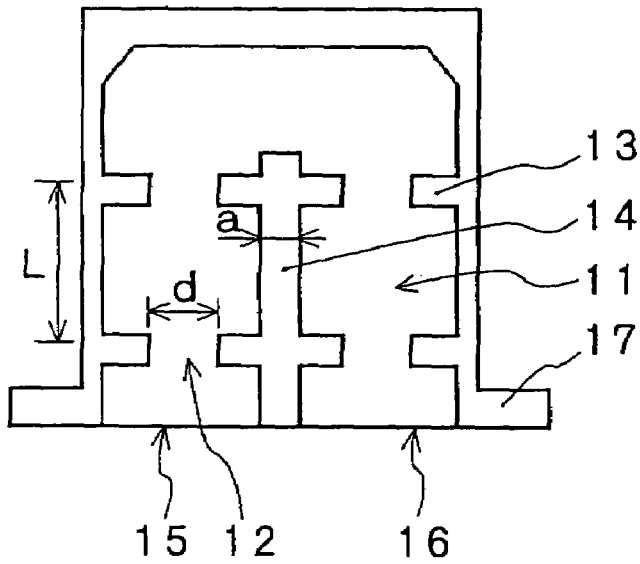

The filter of the present invention is illustrated by referring to figures. In FIG. 1(*a*), there is illustrated an exploded perspective view of one Embodiment of the present invention and in FIG. 1(*b*) a plan view with the cover being removed. A waveguide groove 11 with one surface being open is formed in a U-shape on a body 1, and a plurality of inductive resonant windows is provided at a predetermined interval inside the waveguide groove 11 along a longitudinal direction. A waveguide having the inductive resonant windows 12 is formed by providing a cover 2 on the surface of body 1 as closing the open surface. A cavity, which is enclosed by the two adjacent inductive resonant windows 12 provided along a longitudinal direction of the waveguide 11, body 1 and cover 2, resonates at a predetermined frequency band, and a plurality of inductive resonant windows 12 is provided to pass an electromagnetic wave in a predetermined frequency band. An end of the U-shaped waveguide 11 is to be an input terminal 15, and the other end is to be an output terminal 16, and input/output flange 17 is formed on the same surface of the input terminal 15 and output terminal 16.

The body 1 is composed of a conductive member. A rectangular waveguide is formed through forming the waveguide groove 11, which, for example, includes the cavity of the rectangular waveguide having a size which enables transmission of the electromagnetic wave in a predetermined frequency band, into a U-shape and the top surface is covered with the cover 2 mentioned in following. In the example shown in FIG. 1, the wider surface of the rectangular waveguide is composed of the bottom surface of waveguide groove 11 and the cover 2, and the narrower surface is composed of the wall of waveguide groove 11 in the depth direction. A plurality of pairs of window members 13, which are composed of the inductive resonant windows 12, are provided along a longitudinal direction (transmission direction of the electromagnetic wave) of the waveguide groove 11. In the example shown in FIG. 1, the window members 13 are provided in the form of a pair of plate members directed toward the center from both terminals of the wider surface of the waveguide groove 11 with the entire depth of the groove, and the pair of window members 13 is provided along the longitudinal direction of the waveguide groove 11. The cavity enclosed by the pair of window members 13 being adjacent in the longitudinal direction and the cover 2 which closes the bottom surface, side and top of waveguide 11 becomes a resonator. Through distance d between the pair of window members 13 and interval L of the adjacent window members in a longitudinal direction, a resonant frequency is determined, and the resonator acts as a filter which passes the electromagnetic wave in the resonant frequency band and rejects the electromagnetic wave in other frequencies.

Through forming multiple layers of cavity resonators successively, it is possible to make a clear distinction between the frequency band being passed and rejected. In order to obtain superior filter characteristics for that purpose, the inductive resonant windows 12 are formed successively and multiple layers of resonators are formed. In the present invention, through forming the waveguide groove 11 in a U-shape, the input terminal 15 and output terminal 16 are formed on the same side and the input/output flange 17 is formed therewith. And a filter, which is extremely miniaturized and composed of multiple layers of resonators, is obtained through providing the cavity resonators at the corners of the U-shaped waveguide groove 11.

In the example as shown in FIG. 1, the waveguide groove 11 has the bottom surface being composed of the wider surface of the rectangular waveguide and depth being composed of the narrower surface, and the wider surface is folded back in a U-shape. In the waveguide groove 11, there are provided the window members 13 along the longitudinal direction at a predetermined interval L, and the corners of U-shape are formed by H bend. The waveguide groove 11 being folded back has a side interval of approximately 1 to 20 mm, and the width has the structure in which a large groove being twice in size is divided by a partition plate 14. As a result, the input terminal 15 and output terminal 16 are provided on the same surface and in short distance with the partition plate 14 inbetween, and the input/output flange 17 for attaching to the microwave circuit is formed therewith.

The body 1 has the arrangement in which the partition plate 14 and window member 13 are provided in a large groove, therefore, it is simply formed with predetermined dimension through die casting with metal such as aluminum or zinc. Through forming by die casting, it is possible to form the input/output flange 17 at the same time by an integrated formation. In addition, it is possible to form the body with a plastic material and obtain conductivity by depositing metal inside the body. The filter of the present invention can be obtained through connecting the cover 2 by welding, brazing, screwing or pressing. The cover 2 can be provided with a metal plate such as aluminum or zinc as same as the body 1. However not shown in the figure, by attaching a screw which enables to be inserted inside each resonator from the surface of the cover 2, it is possible to adjust the frequency resonator to obtain a desired value.

According to the present invention, since the waveguide groove is formed in a U-shape and resonators are provided at the corners by the window member, the filter becomes extremely miniaturized. Also, the input terminal and output terminal are formed on the same surface, and the input/output flange is formed therewith. Accordingly, through forming the waveguide of input/output side for the microwave circuit side, the filter can be simply connected by attaching without inserting into the microwave circuit. In other words, it is possible to simply attach the filter regardless of its size without changing the layout of the microwave circuit even if the length of the filter becomes longer by increasing the layers of resonators to obtain the improved filter performance. As a result, the filter can be easily connected without deforming the waveguide, having space at the connecting part or giving damage to transmission characteristics and filter characteristics. Furthermore, since the filter has the structure which is folded back at 180°, even if the length becomes longer with the increased number layers, the length is substantially in half. Therefore, it is possible to obtain the filter with a sharp cut-off frequency and having large attenuation without occupying large space.

Figure 2A:
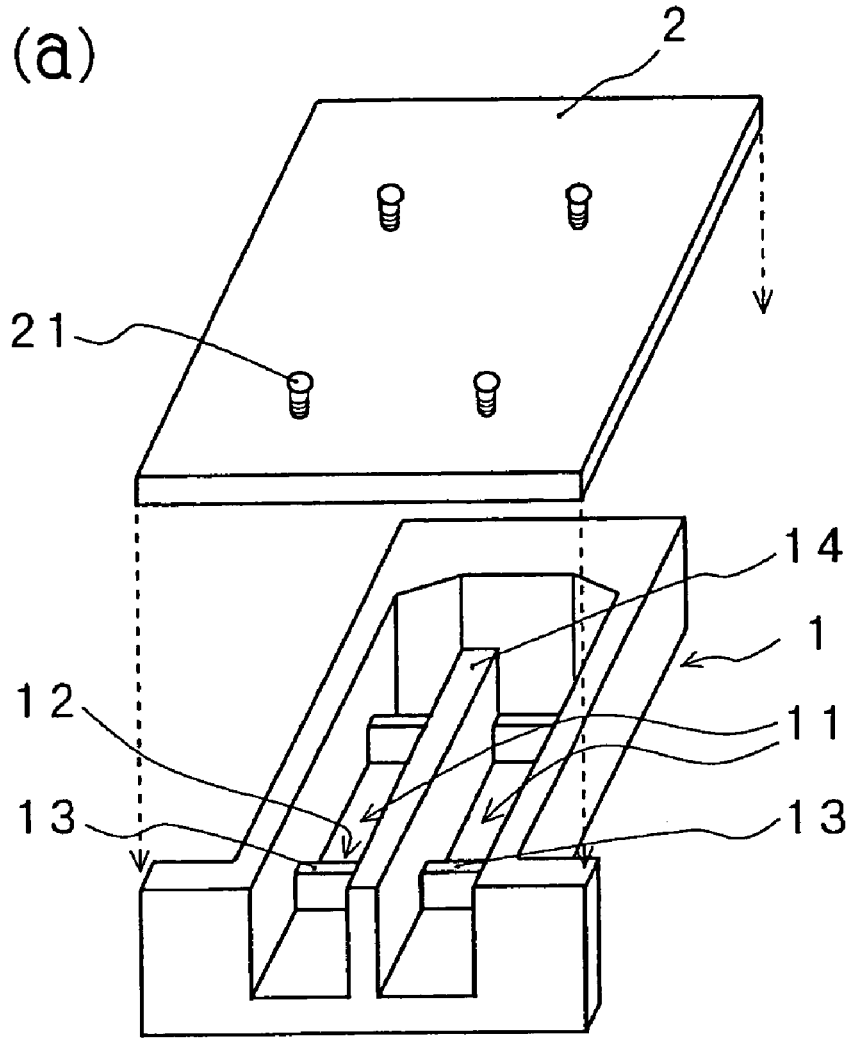
FIG. 2(*a*) and FIG. 2(*b*) are views explaining another Embodiment of a filter according to the present invention.
Figure 2B:
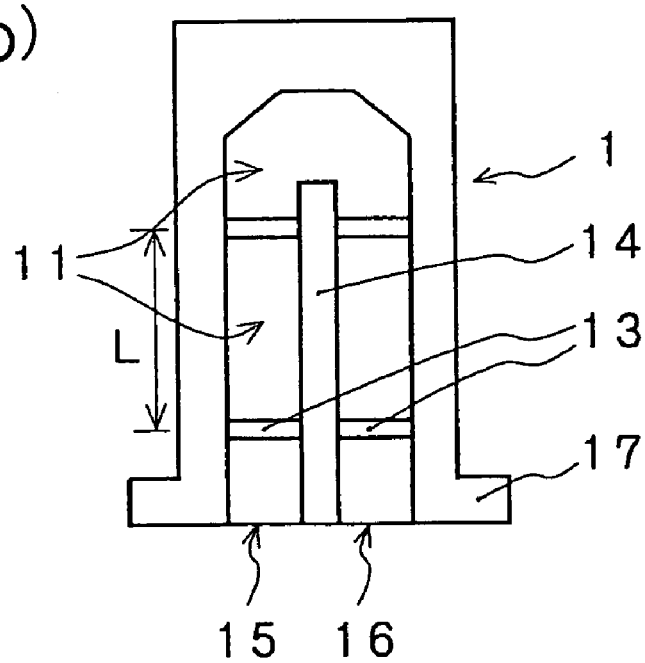

In the above-mentioned example, the waveguide groove is formed in such a manner that the wider surface of the waveguide is to be the bottom surface of the groove and the corners are formed by H bend to obtain the U-shape. However, it is possible to arrange the waveguide in such a manner that the narrower surface of the waveguide is to be the bottom surface and the wider surface is formed by the depth of the groove. An example is shown in FIG. 2 in the same manner as to FIG. 1, i.e., with exploded perspective in FIG. 2(*a*) and in plan view in FIG. 2(*b*). In FIG. 2, the same numerals correspond to the numerals in FIG. 1. In this example, a relationship between length and width is changed as mentioned above, and the inductive resonant windows 12 are formed in asymmetry manner at only one side of the wider surface, in other words the bottom surface side of the waveguide groove 11, since the window members 13 cannot be formed to be directed toward center from the both terminals of the wider surface.

The window member 13 is formed at the bottom surface of the waveguide groove 11 directed toward above by having full width of the groove. The window member 13 is not formed up to the top surface but up to the less than half of the height of the groove, so that the electromagnetic wave can pass therethrough as a window. In other words, the pair of window members is provided at the center part through space in the example shown in FIG. 1, however, the window member 13 is provided only one side against the center line of axis direction of the waveguide in the present example. The resonators are arranged through two adjacent window members 13 and bottom surface of the groove therebetween, sides of the groove and cover 2, and it is possible to provide the resonator which enables to pass the desired frequency band to pass the same as in above-mentioned example. In order to make fine adjustments of the resonant frequency, for example, there are provided screws 21 having adjustable projection length on the cover 2 at parts which are opposing to the window members 13 as shown in FIG. 2. Through modulating the projection length of the screws 21 into the waveguide 11, it is possible to adjust it to resonate at the desired frequency band.

In addition, through arrangement as shown in FIG. 2, since the U-shaped corner can be formed by E bend (arrangement which the wider surface of the waveguide is bent), the width of corner can be extremely short. Accordingly, in case forming the resonator at the corner, it is possible to form a corner with short length without providing the window member at the corner and high performance of the filter can be obtained. It is also possible to thin form the thickness of folded part, and an extremely miniaturized filter can be obtained. Furthermore, an advantage can be obtained through this arrangement that there are fewer occurrences of electric discharge even if a burr is formed on the conjunction surface, since the connecting part of the body 1 and cover 2 corresponds to the end of the wider surface of the waveguide which has the weakest electric field. In such a manner as the above-mentioned example as shown in FIG. 1, the filter can be easily connected by attaching without deforming the waveguide, and high performance of filter and transmission characteristics can be maintained, and the filter can be easily replaced even if the number of layers for resonator is increased. In addition, it is possible to obtain a filter which has a sharp cut-off and a large attenuation in an unnecessary band, while obtaining a miniature filter even if the number of layers for the resonator is increased, since it has a structure which is folded back.

Figure 3:
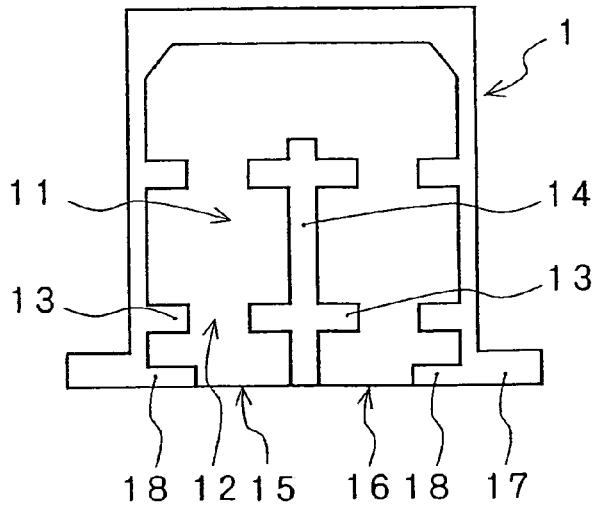
FIG. 3 is a view illustrating a modified example of arrangement as shown in FIG. 1.

FIG. 3 is an example of a modified arrangement from that shown in FIGS. 1(*a*) and 1(*b*). In the example as shown in FIG. 3, the input terminal 15 and output terminal 16 are narrowed by reactance windows 18, and reactance characteristics are given. Through this arrangement, it is possible to improve VSWR characteristics in attaching the filter to the microwave circuit, since impedance matching is carried out with the circuit in series and filter matching is sufficiently carried out. In other words, in case matching of a conventional filter and the lengthwise circuit in which the conventional filter is connected in series is wrong, not only the original characteristics of the filter can be obtained since there is an effect on the circuit in series and characteristics of the filter, but also the circuit in series is affected by the reflected wave. The interference of the filter and circuit in series is dissolved by improved matching through providing the reactance windows 18. Through the present arrangement, stiffness of the opening surface is also improved, and by improved measurement accuracy of production through a method such as die casting, a filter having further improved in performance can be obtained. This is because increase in stiffness results in less deformation by distortion.

In the example as shown in FIG. 3, the reactance windows 18 have an arrangement in which each reactance window 18 is provided only at a side of the wider surface (arrangement which reduces the interval of the narrower surface) for the input terminal 15 and output terminal 16 respectively. However, the reactance windows 18 can be located at both sides of the wider surface, and the same effect can be obtained through an arrangement which reduces the interval of the wider surface. In addition, the reactance window 18 can be located at either input terminal 15 or output terminal 16. This arrangement can be applied to the arrangement as shown in FIG. 2.

Figure 4:
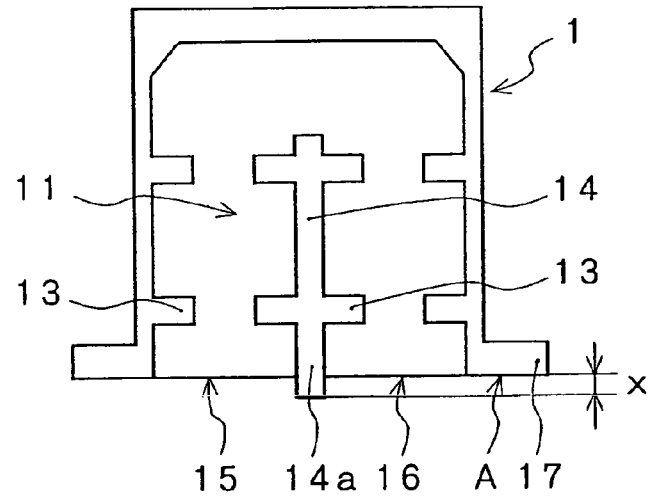
FIG. 4 is a view illustrating a modified example of arrangement as shown in FIG. 1.
Figure 5:
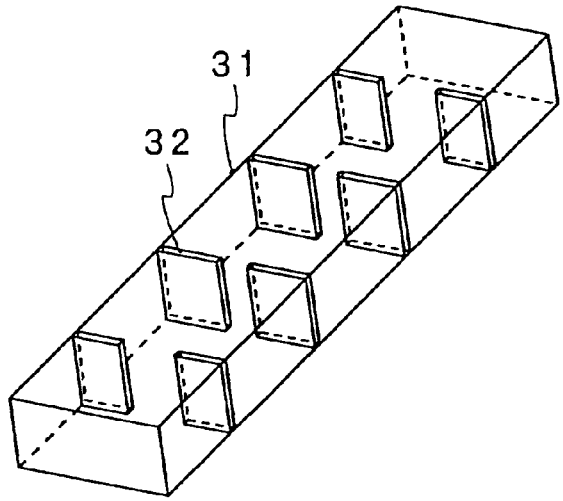
FIG. 5 (PRIOR ART)
FIG. 5 is a view illustrating an example of arrangement of a conventional filter.
Figure 6:
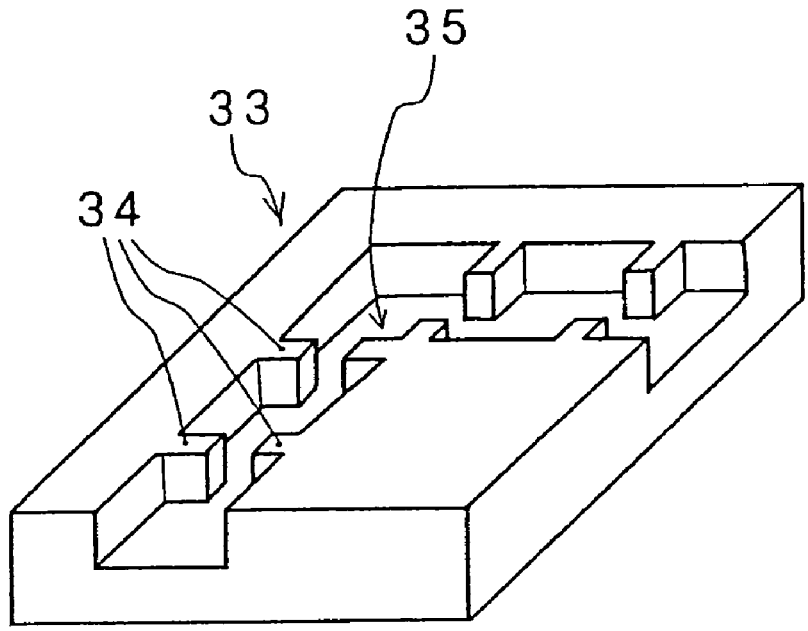
FIG. 6 (PRIOR ART)
FIG. 6 is a view illustrating an example of arrangement of a conventional filter.

FIG. 4 is another example of modified arrangement from that shown in FIG. 1. A top 14*a* of the partition plate 14 which is a division of the waveguide groove 11 being folded back in U-shape projects by x from a surface A of the input/output flange 17 of the filter. When attaching the filter to the middle of the microwave circuit, terminals of front circuit and rear circuit of circuit is aligned and connected by attaching. In this case, the top 14*a* of the partition plate 14 which projects by x is certainly contacted and characteristic defects in connecting can be prevented. The size of projection x will be different depending on the size of waveguide or compressive force in tighting, however, the top 14*a* of the partition plate 14 was certainly connected by having the length of 14*a* approximately at 0.02 to 0.5 mm. This arrangement can be also applied to the arrangement as shown in FIG. 2.

What is claimed is:

1. A filter, comprising:

a body for forming a U-shaped waveguide groove thereon, said U-shaped waveguide groove having two openings on one side of the body and a plurality of inductive resonant windows along a longitudinal direction of the waveguide groove at a predetermined interval; and a cover placed on a top surface of said body so as to cover said waveguide groove;

wherein said plurality of inductive resonant windows are provided in such a manner that a cavity, which is enclosed by two of said plurality of inductive resonant windows being adjacent, said body and said cover, resonates at a predetermined frequency and passes a electromagnetic wave in a predetermined frequency band;

wherein one opening of said two openings is an input terminal for inputting the electromagnetic wave and the other opening of said two openings is an output terminal for outputting the electromagnetic wave; and wherein said waveguide groove forms a waveguide in such a manner that a wider surface of the waveguide is along a depth direction of the groove, a narrower surface of the waveguide is provided by said cover, and two wider surfaces extend from said input terminal and output terminal.

2. A filter, comprising:

a body for forming a U-shaped waveguide groove thereon, said U-shaped waveguide groove having two openings on one side of the body and a plurality of inductive resonant windows along a longitudinal direction of the waveguide groove at a predetermined interval; and a cover placed on a top surface of said body so as to cover said waveguide groove;

wherein said plurality of inductive resonant windows are provided in such a manner that a cavity, which is enclosed by two of said plurality of inductive resonant windows being adjacent, said body and said cover, resonates at a predetermined frequency and passes a electromagnetic wave in a predetermined frequency band;

wherein one opening of said two openings is an input terminal for inputting the electromagnetic wave and the other openings of said two openings is an output terminal for outputting the electromagnetic wave; and wherein said waveguide groove forms a waveguide in such a manner that a narrower surface of the waveguide is along a depth direction of the groove, a wider surface of the waveguide is provided by said cover, and two wider surfaces are laterally aligned with respect to said input terminal and output terminal.

3. A filter, comprising:

a body for forming a U-shaped waveguide groove thereon, said U-shaped waveguide groove having two openings on one side of the body and a plurality of inductive resonant windows along a longitudinal direction of the waveguide groove at a predetermined interval; and a cover placed on a top surface of said body so as to cover said waveguide groove;

wherein said plurality of inductive resonant windows are provided in such a manner that a cavity, which is enclosed by two of said plurality of inductive resonant windows being adjacent, said body and said cover, resonates at a predetermined frequency and passes a electromagnetic wave in a predetermined frequency band;

wherein one opening of said two openings is an input terminal for inputting the electromagnetic wave and the other opening of said two openings is an output terminal for outputting the electromagnetic wave; and wherein a reactance member which narrows said waveguide groove is provided at least one side of said input terminal and output terminal inside the waveguide groove.

4. A filter, comprising:

a body for forming a U-shaped waveguide groove thereon, said U-shaped waveguide groove having two openings on one side of the body and a plurality of inductive resonant windows along a longitudinal direction of the waveguide groove at a predetermined interval; and a cover placed on a top surface of said body so as to cover said waveguide groove;

wherein said plurality of inductive resonant windows are provided in such a manner that a cavity, which is enclosed by two of said plurality of inductive resonant windows being adjacent, said body and said cover, resonates at a predetermined frequency and passes a electromagnetic wave in a predetermined frequency band;

wherein one opening of said two openings is an input terminal for inputting the electromagnetic wave and the other opening of said two openings is an output terminal for outputting the electromagnetic wave; and wherein a partition plate which divides input side and output side of said U-shaped waveguide groove is provided so as to protrude from the same surface formed by said input terminal and output terminal.

* * * * *

UNITED STATES PATENT AND TRADEMARK OFFICE

CERTIFICATE OF CORRECTION

PATENT NO. : 7,304,554 B2
APPLICATION NO. : 11/135930
DATED : December 4, 2007
INVENTOR(S) : Hideyuki Obata It is certified that error appears in the above-identified patent and that said Letters Patent is hereby corrected as shown below:

In column 6, line 52, “thin” should be --thinly--.

In column 8, line 32, claim 2, line 19 “openings” should be --opening--.

Signed and Sealed this

Seventeenth Day of June, 2008

JON W. DUDAS
*Director of the United States Patent and Trademark Office*